US008317468B2

(12) United States Patent
Vedsted et al.

(10) Patent No.: US 8,317,468 B2
(45) Date of Patent: Nov. 27, 2012

(54) FLOW-ROUTING COMPONENT OF A PUMP

(75) Inventors: Per Frost Vedsted, Bjerringbro (DK); Martin Vad, Randers (DK)

(73) Assignee: Grundfos Management a/s, Bjerringbro (DK)

( * ) Notice: Subject to any disclaimer, the term of this patent is extended or adjusted under 35 U.S.C. 154(b) by 620 days.

(21) Appl. No.: 12/500,687

(22) Filed: Jul. 10, 2009

(65) Prior Publication Data

US 2010/0008775 A1 Jan. 14, 2010

(30) Foreign Application Priority Data

Jul. 10, 2008 (EP) ..... 08012463

(51) Int. Cl.
*F03B 11/00* (2006.01)

(52) U.S. Cl. ..... 415/208.2; 416/186 R

(58) Field of Classification Search ..... 415/209.1, 415/915, 208.2, 208.4, 208.5, 199.1; 416/186 R
See application file for complete search history.

(56) References Cited

U.S. PATENT DOCUMENTS 6,146,094 A * 11/2000 Obana et al. ..... 415/200
2007/0274828 A1* 11/2007 Fukuki ..... 415/199.1

FOREIGN PATENT DOCUMENTS

| | | | |
|---|---|---|---|
| CN | 2426027 | Y | 4/2001 |
| CN | 1824434 | A | 8/2006 |
| DE | 197 09 651 | A1 | 10/1997 |
| DE | 29904668 | U1 | 6/1999 |
| EP | 1 207 296 | A1 | 5/2002 |
| WO | 00/51949 | A1 | 9/2000 |

OTHER PUBLICATIONS

Office Action issued May 16, 2011 in CN Application No. 200910140252.3.

* cited by examiner

*Primary Examiner* — Dwayne J White
(74) *Attorney, Agent, or Firm* — Panitch Schwarze Belisario & Nadel LLP

(57) ABSTRACT

A flow-routing component of a pump is composed of at least two parts, a first part (2) of the component being manufactured by metal-powder injection molding, and a second part (4) of the component being manufactured from sheet metal. A pump assembly is also provided having such a flow-routing component.

17 Claims, 4 Drawing Sheets

FLOW-ROUTING COMPONENT OF A PUMP

BACKGROUND OF THE INVENTION

The invention relates to a flow-routing component of a pump, which component is composed of at least two parts.

Such flow-routing components of pumps are known, for example, in the form of impellers or distributors of centrifugal pumps. These impellers or distributors often consist of two shrouds spaced apart from one another and having blades lying between them. In this context, it is known for impellers or distributors of this type to be composed of a plurality of parts, for example of sheet metal parts. Thus, it is known to manufacture the shrouds and the blades as individual parts from sheet metal and then to weld them to one another.

This manufacture is highly complicated, since a multiplicity of individual parts have to be connected to one another.

BRIEF SUMMARY OF THE INVENTION

An object of the invention, therefore, is to improve a multipart flow-routing component of a pump such that this component can be manufactured more simply and more cost-effectively.

This object is achieved by a flow-routing component of a pump, which component is composed of at least two parts, wherein a first part of the component is manufactured by metal-powder injection molding, and a second part of the component is manufactured from sheet metal or as a metal-powder injection molding or as a plastic molding.

The flow-routing component according to the invention is an element of a pump and serves there for routing the flow of the fluid to be conveyed by the pump, for example for the routing of water. In particular, the component serves for guiding or deflecting the flow. The flow-routing component according to the invention is composed of at least two parts, but may also be composed of more than two parts. The several parts of the flow-routing component together define a flow path in the flow-routing component, that is to say that the several parts serve together for flow routing, in particular flow guidance, pressure generation and/or pressure conversion.

According to an embodiment of the invention, a first part of the component is manufactured by metal-powder injection molding. In this method, a metal powder, together with plastic, is first shaped in an injection molding method, which corresponds to the injection molding of plastic, and is subsequently heated in a similar way to a sintering method, the plastic evaporating from the component, and the metal powder melting to form a homogeneous metal component. The evaporation of the plastic results in a shrinkage of the component, which, however, can be taken into account in shaping by injection molding. This method thus makes it possible to manufacture high-precision metal components very cost-effectively, since, in particular, the shaping process is very simple and cost-effective. Shaping is much more cost-effective than, for example, in conventional metal casting, because no expendable molds are used and the die wear is markedly lower.

Furthermore, according to an embodiment of the invention, a second part of the component is preferably manufactured from sheet metal. The first and the second component are then assembled and then together, if appropriate with additional parts, form the flow-routing component.

The combination of a part which is manufactured by metal-powder injection molding and of a part which is manufactured from sheet metal makes it possible to manufacture very simply highly complex flow-routing components. It is thus possible to produce complex geometries by metal-powder injection molding. At the same time, however, it is possible to restrict it to those geometries which can be produced by injection molding without expendable cores. That is to say, undercuts and cavities can be avoided. Insofar as these are required in the flow-routing component, they are then formed by the first and the second part being assembled. The second part is preferably a part which has no complex geometries, so that the second part can be stamped and/or formed from sheet metal cost-effectively.

Thus, precisely the combination of a metal-powder injection-molded part and of a sheet metal part makes it possible, overall, to produce a complex flow-routing component highly cost-effectively. In this case, production is markedly simpler and more cost-effective than if the entire component were manufactured from injection-molded metal powder or from sheet metal parts.

Alternatively, according to an embodiment of the invention, there is provision for the second part, which has no complex geometries, to be produced as a plastic molding, for example as a plastic injection molding. The connection to the metal-powder injection molding can then take place, for example, in such a way that tendon-like extensions are provided in the metal-powder injection molding, which engage into recesses arranged correspondingly thereto in the second part and which, on the other side of the second part are deformed or bent round or upset in the manner of a rivet, in order thereby to connect the parts into one component.

Furthermore, according to an embodiment of the invention, there is provision for producing the second part of the component likewise as a metal-powder injection molding. Such an implementation has the advantage that the two parts of the component can be connected to one another particularly simply and intimately, in that, before sintering, they are laid one onto the other, as intended, and, during sintering, are thus connected to one another in a materially integral manner in the region of the bearing faces.

If the flow-routing component is composed of more than two parts, then it is also possible to manufacture more than one part from sheet metal and/or more than one part by metal-powder injection molding. It is essential for the invention, however, that at least one part is composed of sheet metal, of injection-molded metal powder or is a plastic molding and at least one part is composed of injection-molded metal powder in order to form the flow-routing component.

Preferably, the first and the second part are connected firmly to one another, in particular welded to one another. Thus, after the parts have been assembled by the parts being connected, a one-part flow-routing component is produced which can be easily handled during further processing, in particular during the fitting of a pump assembly. Preferably, the sheet metal part and the metal-powder injection molding are to be welded to one another, for example by induction welding. This makes it possible to connect the two parts to one another very simply. For connection, projections which later form weld spots may be formed on one of the parts. It is appropriate, in particular, to form these projections in the metal-powder injection molding, and, for welding, these projections then come into contact with the part made from sheet metal. When a current is applied to both parts, the parts then can be easily welded to one another.

Preferably, the first part, which is manufactured by metal-powder injection molding, has one or more blades for flow routing. These blades serve, in particular, in a pump, for deflecting the fluid to be conveyed or for guiding the latter in a desired direction. Precisely blades of this type have a complex geometry which can be formed in a simple way cost-effectively by metal-powder injection molding. Blades of this type may be present, for example, on an impeller or a distributor of a pump assembly. Thus, according to a first preferred embodiment, the flow-routing component is designed as a pump impeller.

Preferably, further, the first part is a first shroud of a pump impeller, which shroud is manufactured in one piece with the blades of the pump impeller by metal-powder injection molding, and the second part is a second shroud manufactured from sheet metal. A pump impeller of this type can be beneficially manufactured in the above-described way or method according to the invention. The first shroud having the complex blade geometry is produced as a metal-powder injection molding. The second shroud of less complex design can, by contrast, be stamped and/or formed from sheet metal cost-effectively. Thus, a particularly suitable production method can be used for each of the two parts. The two parts are subsequently connected to one another, preferably welded to one another. For this purpose, projections may be formed on the blades manufactured by metal-powder injection molding, along the free longitudinal edges facing away from the associated shroud, and serve for welding to the shroud. The shroud made from sheet metal is pressed onto these projections, and the arrangement is then subjected to a current which leads to a welding of the first and second parts to said projections.

Preferably, further, the first part has a hub which is manufactured in one piece with the shroud and the blades by metal-powder injection molding. This hub serves for fastening the impeller to a drive shaft. Since this hub serves for torque transmission from the shaft to the impeller, it is preferable to produce said hub in one piece with the shroud and the blades, since a high strength can thereby be achieved. Moreover, if appropriate, the hub may also have a complex geometry, in order to achieve a positive connection to the drive shaft for force transmission. Such a geometry can likewise be manufactured beneficially by metal-powder injection molding. Since the hub, the first shroud and the blades can be manufactured in one operation, furthermore, the number of manufacturing and assembly steps required is reduced.

According to a further preferred embodiment, the hub may have a thread which is formed directly on the hub by metal-powder injection molding. This thread may serve for receiving a fastening element, for example a clamping screw for fixing the hub to the drive shaft. Metal-powder injection molding makes it possible to form the thread in the required precision directly during the formation of the hub, so that further machining steps, in particular patting machining for introducing the thread, may be dispensed with.

Thus, preferably, all the components of the impeller which have a demanding or complex geometry, in particular blades, hub and fastening elements, such as a thread, present on the hub, are formed in one operation by metal-powder injection molding, so that the number of further manufacturing and assembly steps for forming the impeller can be reduced.

According to a second preferred embodiment, the flow-routing component according to the invention is designed as a pump distributor, in particular for a multistage centrifugal pump. Distributors of this type serve for transferring in a desired way from an impeller of the centrifugal pump fluid, for example water, which emerges on the outer circumference. In particular, the distributor serves for routing fluid radially inwardly again, so as then to deliver it to an outlet connection piece of the pump or else to the next pump stage, that is to say the suction mouth of the next impeller. In the same way as the impellers of the pump, such distributors have a complex geometry too, which can be formed cost-effectively in the above-described way by the component configuration, which according to the invention is in at least two parts. In this distributor, too, the complexly shaped structures can be manufactured by metal-powder injection molding, while parts which are of simpler geometry can be stamped or formed from sheet metal. The two parts can subsequently be assembled or connected to one another.

Preferably, in the embodiment of the flow-routing component as a distributor, the first part of the component is a first shroud which is manufactured in one piece with the blades of the distributor by metal-powder injection molding, and the second part of the component is a second shroud manufactured from sheet metal. As described above with regard to the impeller, the blades, which may have a complicated geometry, can thereby be shaped together with a shroud in a simple way, so that they are firmly connected to the shroud. The second shroud, which is essentially planar, can be manufactured cost-effectively from sheet metal. The two parts can subsequently be connected to one another. This connection may take place in the way described above with regard to the impeller.

Preferably, further, the first part of the distributor is a first shroud, with which an axially extending bearing ring is formed in one piece by metal-powder injection molding. The ring is designed to come to bear with a sealing insert. As described above, the distributor in a multistage centrifugal pump serves for routing the fluid radially inwardly again to the suction mouth of a following impeller. In this case, it is necessary that the suction mouth of the following impeller come to bear, sealed off with respect to the outlet of the distributor. For this purpose, a sealing insert is provided, which can also at the same time ensure sealing off with respect to the surrounding housing. In order to fix this sealing insert to the distributor, the latter preferably has formed on it a seat in the form of the bearing ring described. By the metal-powder injection molding method being employed, it is also possible to form a bearing ring of this type or a differently shaped seat for sealing elements on the distributor cost-effectively in one work step.

Furthermore, the distributor preferably likewise has formed in it, in one piece with the first shroud, a bearing seat into which a bearing for mounting the drive shaft for the impellers of the pump can be inserted.

Preferably, the pump distributor has at least one projection which is directed radially outward with respect to the pump longitudinal axis and by which the distributor can be fixed between two parts of a pump casing. The projection projects radially outwardly beyond the outer circumference of the distributor, so that said projection can come to lie between the end faces of two casing parts. These casing parts are in each case assigned to a pump stage and are fixed from outside via tension straps. The projection of the distributor is clamped between the two casing parts adjacent to one another, with the result that the distributor is fixed in the axial direction in the pump casing. The projections are in this case formed in one piece with the other parts of the distributor, which are manufactured by metal-powder injection molding. The metallic nature of the projections allows good force transmission, particularly a high surface pressure, when the projections are clamped between the adjacent casing parts. This, in turn, makes it possible to ensure that no enlarged bearing faces for reducing the surface pressure have to be formed at the axial ends of the casing parts. Instead, the casing parts may simply be of tubular design, the end faces of the tube forming bearing faces for the projection. That is to say, the end faces have the same cross-sectional area as the tube wall at any other point on the tube. In particular, they have no widened inside or outside diameter. This simplifies manufacture, since the casing parts may be designed as simple tube segments which can either be cut to length from a longer tube or else be bent from a metal sheet, in which case only the end faces have to be machined flat, if appropriate. The projection can be formed cost-effectively in one piece with the other parts of the distributor by metal-powder injection molding. A plurality of projections, preferably distributed uniformly on the circumference, may be formed, and particularly preferably a projection is in the form of an annular protrusion. That is to say, the projection is formed as a radially directed ring or collar which extends over the entire circumference of the distributor.

The invention relates, furthermore, to a pump assembly, in particular a single-stage or multistage centrifugal pump assembly, which has at least one flow-routing component according to the above description. Preferably, this pump assembly has one or more impellers and/or one or more distributors according to the above description. These impellers and/or distributors may be manufactured, by the above-described system or method according to the invention, in each case from at least two parts, of which one part is manufactured by metal-powder injection molding and one part is manufactured from sheet metal.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
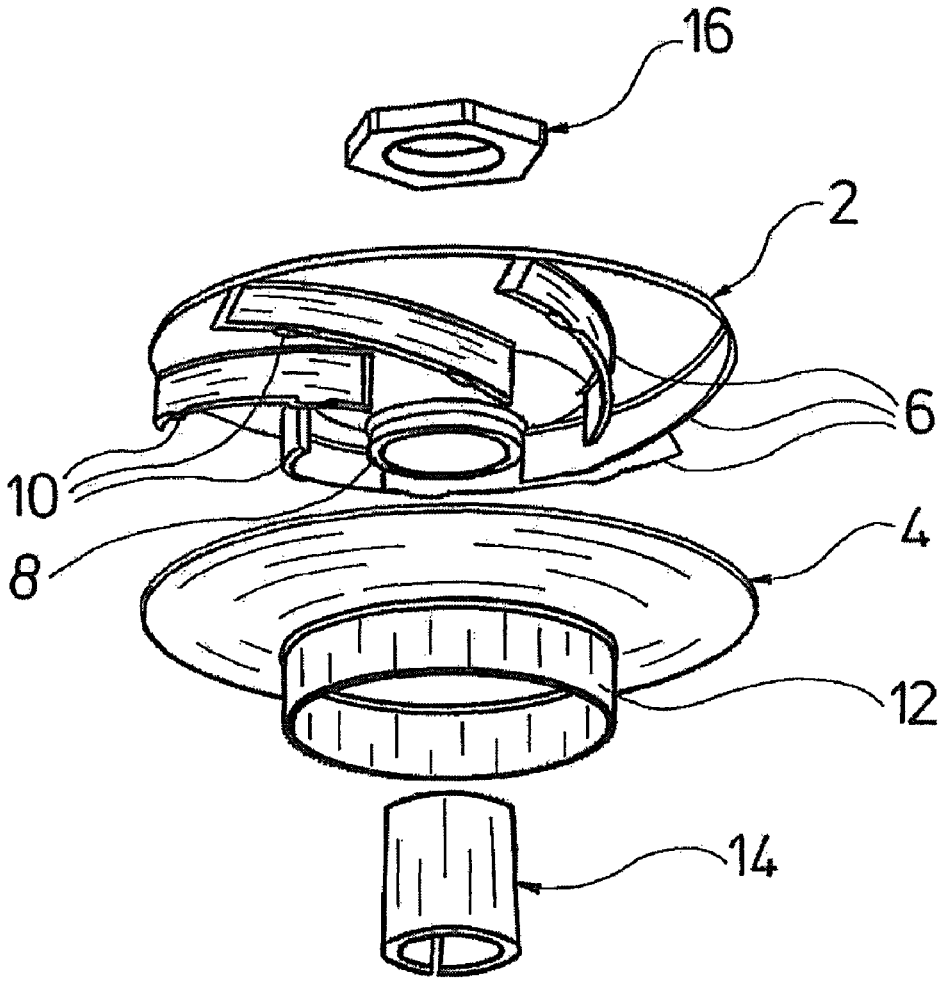
FIG. 1 is an exploded, bottom perspective view of a pump impeller which forms a flow-routing component according to one embodiment of the invention.

A flow-routing component according to one embodiment of the invention, which is configured as a pump impeller of a centrifugal pump assembly, is described in more detail with reference to FIGS. 1 and 2.

The impeller consists essentially of two parts, to be precise a first shroud 2 and a second shroud 4. The first shroud 2 carries the blades 6 and has at its center a hub 8 which serves for fastening to a drive shaft. The first shroud 2 forms, together with the blades 6 and the hub 8, a first part of the impeller. This first part is manufactured from metal, for example stainless steel, by metal-powder injection molding. In this case, the shroud 2, blades 6 and hub 8 are manufactured in one piece in one operation. Metal-powder injection molding makes it possible to produce very simply the plurality of blades, together with the shroud 2 and hub 8, in one piece in one operation. By metal-powder injection molding, even complex blade geometries of the blades 6 can be produced very simply. The blades 6 have at their free longitudinal edges facing away from the shroud 2 projections 10 which serve for welding the shroud 2 having the blades 6 to the second shroud 4.

This second shroud 4 is manufactured from a metal sheet, preferably a stainless steel sheet. This takes place by stamping and forming. The shroud 4 is slightly funnel-shaped and at its center has an axially projecting collar 12 which forms the suction mouth of the impeller. The shroud 4, together with the collar 12 formed in one piece, can be manufactured cost-effectively as a sheet metal part.

Figure 2:
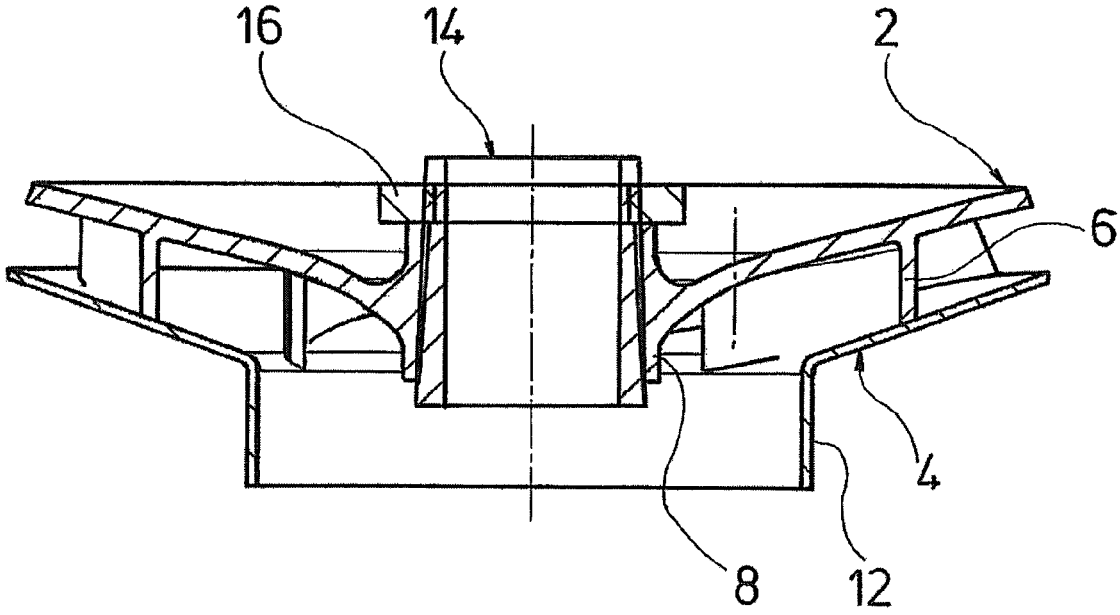
FIG. 2 is a side sectional view of the pump impeller according to FIG. 1 in the mounted state.

After the two parts have been manufactured separately, they are assembled into the impeller, as shown in FIG. 2. For this purpose, the shroud 4 is pressed onto the projections 10 on the blades 6 and is welded inductively to the free longitudinal edges of the blades 6. This gives rise to a one-part impeller, as shown in FIG. 2. Manufacturing the impeller in two parts has the advantage that the cavities forming the flow ducts inside the impeller can be formed very simply and cost-effectively. Thus, cores may be dispensed with during molding. The first part, manufactured by metal-powder injection molding and consisting of the shroud 2, blade 6 and hub 8, preferably has no undercuts, so that it can be molded easily in a two-part injection molding die. However, this does not rule out the possibility that the blades are also designed in more complex forms, which can be implemented by a multi-part injection molding die or inserted cores.

Furthermore, for fastening to a shaft, a clamping cone 14 and a tension nut 16 screwed onto the latter are provided. The slotted clamping cone 14 is inserted into the hub 8 and receives the drive shaft inside it. By the tension nut 16, which is screwed onto the thin end of the clamping cone 14, the clamping cone 14 is drawn into the hub 8 and, by virtue of its conical outer contour, is at the same time pressed radially inwardly, so that the passage orifice receiving the shaft can be reduced in size and the clamping cone 14, together with the surrounding hub 8 and consequently the entire impeller, can be clamped onto the drive shaft.

Figure 3:
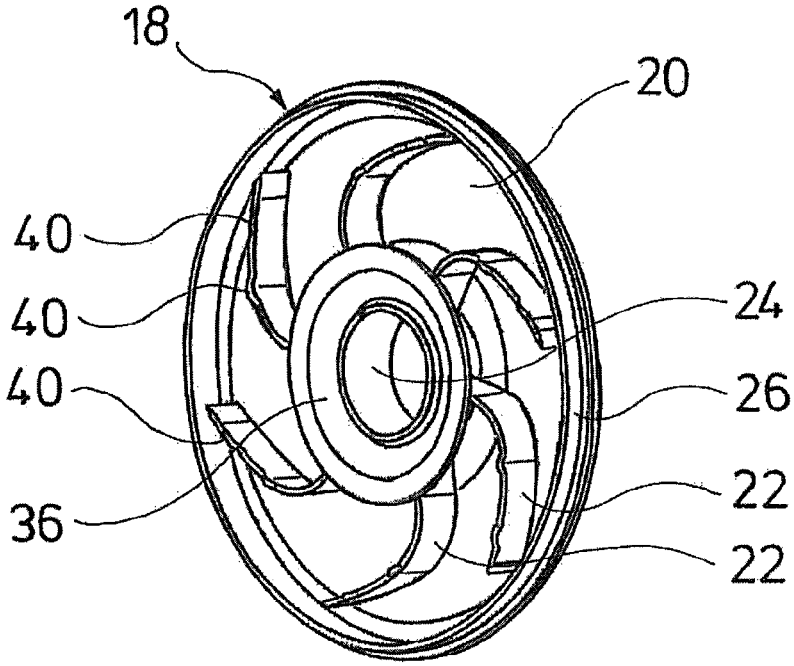
FIG. 3 is a perspective view of a first part of a pump distributor which forms a flow-routing component according to an embodiment of the invention.
Figure 4:
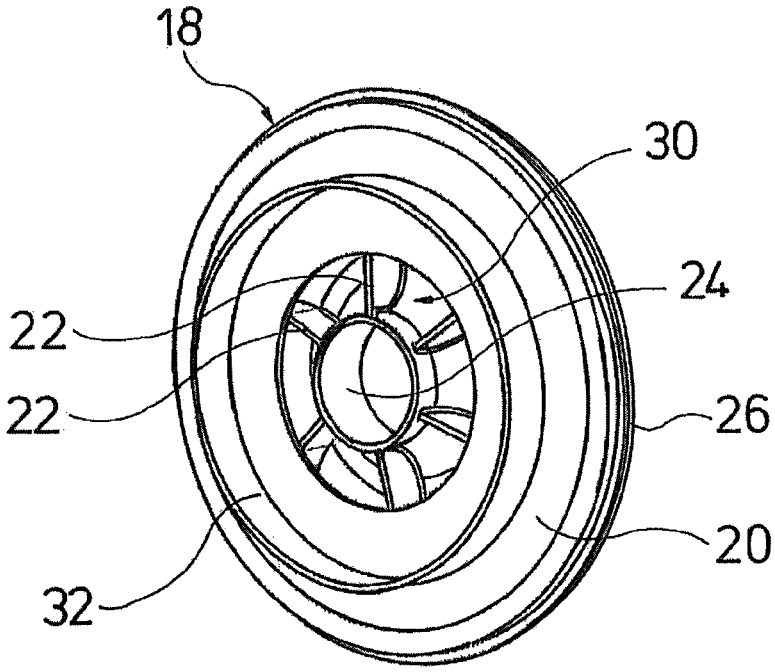
FIG. 4 is a perspective view of the first part of the pump distributor according to FIG. 3, as seen from the rear side.

A second example of a flow-routing component according to the invention is described with reference to FIGS. 3 to 5, which show a distributor 17.

This distributor 17, too, is of two-part design. FIGS. 3 and 4 show the first part 18 from two sides. The first part 18 of the distributor 17 is formed essentially by a shroud 20 with guide blades or blades 22 formed on it. The blades 22 terminate at their radial end at a bearing holder 24, which is likewise connected or manufactured in one piece with the shroud 20. The bearing holder 24 is a cylindrical sleeve which is designed for receiving a bearing 26 (see FIG. 5). This bearing 26 serves for mounting the drive shaft for the impellers.

Figure 5:
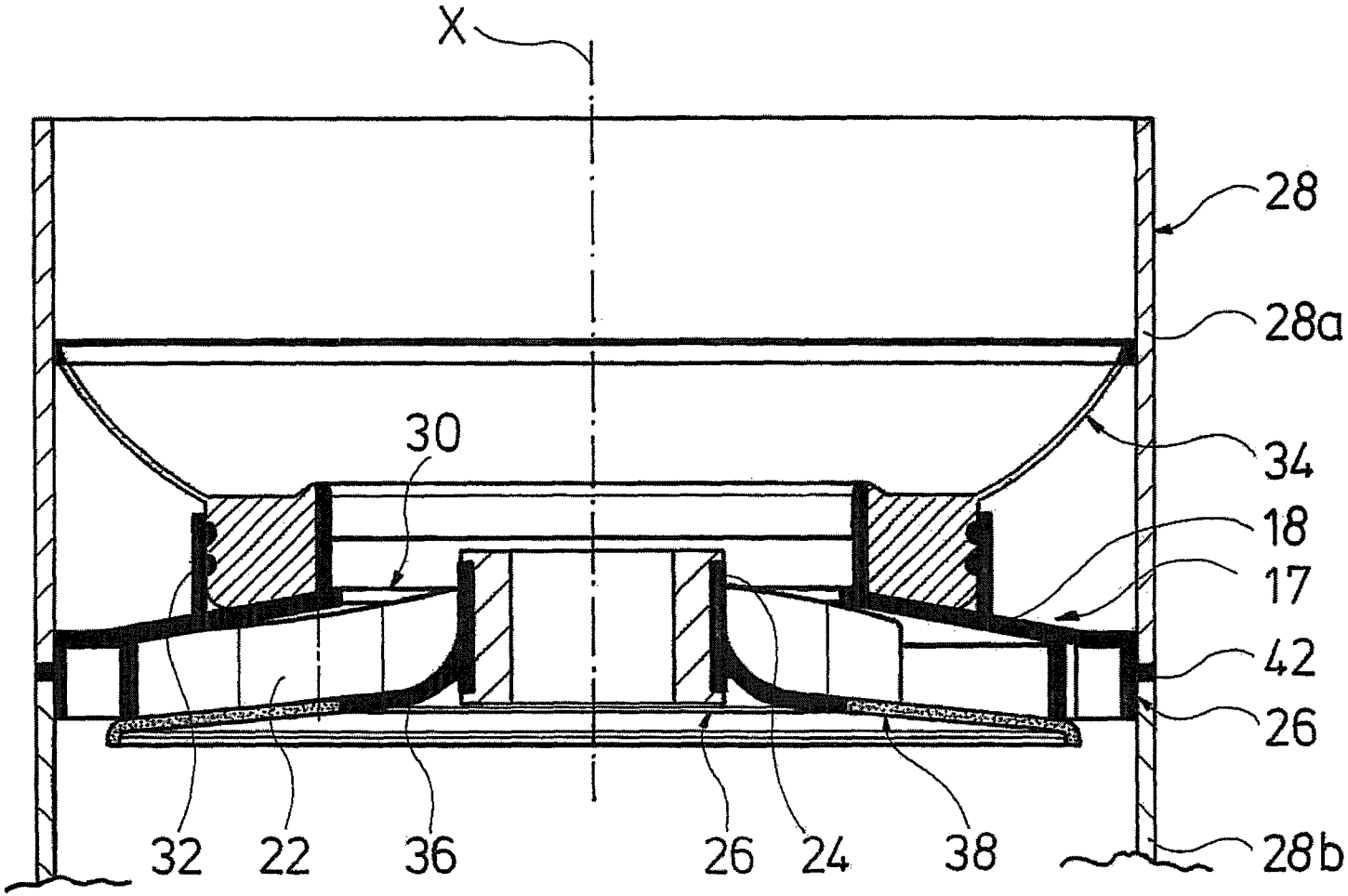
FIG. 5 is a side sectional view of the pump distributor according to FIGS. 3 and 4 in the installed state.

Furthermore, the outer circumference of the shroud 20 has adjoining it an axially extending ring 26, which forms the circumferential casing of the distributor and which is provided for connection to a pump casing 28, which is shown in FIG. 5.

The shroud 20 has in its central region an orifice 30 which forms the outlet orifice of the distributor 17. The orifice 30 has a diameter which is larger than the diameter of the bearing holder 24, so that the blades 22 extend inward in a radial direction beyond the outer circumference of the orifice 30. A bearing ring surrounds, spaced apart radially outwardly, the orifice 30 and serves for receiving a sealing element 34. The bearing ring 32 extends as a cylindrical ring in the axial direction from the shroud 20 in the opposite direction to the blades 22.

At that end of the blades 22 which is axially opposite the shroud 20, a collar 36 is formed in the central region and extends essentially radially outwardly from the bearing holder 24. In this case, the collar 36 extends beyond the longitudinal edges of the blades 22 and thus forms part of a second shroud of the distributor 17. The collar 36 has in this case an outside diameter which corresponds to the inside diameter of the orifice 30. However, the outside diameter could also be smaller than the inside diameter of the orifice 30. The effect of both is that the shroud 20 and the collar 36 do not overlap one another in the radial direction. Thus, the first part 18 of the distributor has no undercuts, so that shaping in a two-part die is possible. The first part 18 of the distributor 17 is manufactured completely as a one-piece component by metal-powder injection molding. That is to say, the first shroud 20, with the blades 22, the bearing holder 24, the ring 26, the bearing ring 32 and the collar 36, is manufactured in one piece in one operation as a metal-powder injection molding.

The second part 38 of the distributor 17, which is shown in the mounted state in FIG. 5, is a sheet metal part which is manufactured by stamping and forming. This sheet metal part forms the essential part of the second shroud of the distributor 17 and, in the mounted state, extends outwardly in radial prolongation from the collar 36. The collar 36 and the second part 38 thus together form the second shroud. The second part 38 is welded to the free longitudinal edges of the blades 22. For this purpose, projections 40 (see FIG. 3) are integrally formed on the blades 22 and serve for inductive welding to the second part 38.

In this second exemplary embodiment too, that is to say the distributor 17, it can be seen that the method according to the invention or the design according to the invention makes it possible to produce the complex or complicated geometries of the distributor 17 by metal-powder injection molding, and the combinations with a second part, a sheet metal part, in this case make it possible that this first part 18, which is manufactured by metal-powder injection molding, can be produced without pronounced undercuts or cavities. Simple injection molding thus becomes possible. The second part 38, which is then welded to the first part 18, has a very simple geometry, and therefore it can be manufactured from sheet metal in a simple way.

Furthermore, it can be seen in FIG. 5 how the distributor 17 is fixed in the pump casing 28. The pump casing 28 is formed from a plurality of casing parts 28*a* and 28*b*. In this case, each pump stage is assigned a casing part 28*a*, 28*b*. FIG. 5 shows two casing parts 28*a* and 28*b*. It must be understood that, in the case of a pump with more than two stages, correspondingly more casing parts are provided. A distributor 17 is fixed in each case between two casing parts 28*a* and 28*b*. For this purpose, the distributor 17 has on its outer circumference, which, moreover, corresponds essentially to the inner circumference of the casing parts 28*a* and 28*b*, a projection 42 protruding radially outwardly with respect to the longitudinal axis X. The projection 42 protrudes annularly outwardly in the radial direction and is manufactured in one piece with the first part 18 of the distributor 17 by metal-powder injection molding. The casing parts 28*a*, 28*b* and, if appropriate, further casing parts are pressed together from outside by tension elements, such as tension straps or tension bolts. The projection 42 of the distributor is in this case clamped between the end faces of the casing parts 28*a* and 28*b*. Since the projection of the distributor 42 is likewise produced from metal, it can easily absorb the compressive forces occurring, without experiencing deformation. This makes it possible, in this region, to dispense with special widened bearing faces for reducing the surface pressure. Instead, the casing parts 28*a* and 28*b* bear with the normal wall cross-sectional area against the projection 42. The projection 42 extends in the radial directional as far as the outer circumference of the casing parts 28*a* and 28*b*, so that a continuous smooth outer face of the pump casing 28 is formed. The projection 42 fixes the distributor in the axial direction. The distributor is fixed in the radial direction in that it comes to bear with its outer circumference against the inner circumference of the pump casing 28.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A flow-routing component of a pump, the component comprising at least two parts, wherein a first part (2; 18) of the component comprises injection molded metal-powder, and a second part (4; 38) of the component comprises sheet metal.

2. The flow-routing component as claimed in claim 1, wherein the first part (2; 18) and the second (4; 38) part are connected firmly to one another.

3. The flow-routing component as claimed in claim 2, wherein the first part (2; 18) and the second (4; 38) part are welded to one another.

4. The flow-routing component as claimed in claim 1, wherein the first part (2; 18) has one or more blades (6; for flow routing.

5. The flow-routing component as claimed in claim 1, wherein the component is designed as a pump impeller.

6. The flow-routing component as claimed in claim 5, wherein the first part (2) is a first shroud, which is manufactured in one piece with blades (6) of the pump impeller, and the second part (4) is a second shroud.

7. The flow-routing component as claimed in claim 6, wherein the first part (2) has a hub (8), which is manufactured in one piece with the shroud and the blades (6).

8. The flow-routing component as claimed in claim 7, wherein the hub (8) has a thread which is formed directly on the hub (8).

9. The flow-routing component as claimed in claim 1, wherein the component is designed as a pump distributor.

10. The flow-routing component as claimed in claim 9, wherein the pump distributor is for a multistage centrifugal pump.

11. The flow-routing component as claimed in claim 9, wherein the first part (18) is a first shroud, which is manufactured in one piece with blades (22) of the distributor, and the second part (28) is a second shroud.

12. The flow-routing component as claimed in claim 9, wherein the first part (18) is a first shroud, which is formed in one piece with an axially extending bearing ring (32), the ring being designed to come to bear with a sealing insert (34).

13. The flow-routing component as claimed in claim 9, wherein the pump distributor has at least one projection, the projection being directed radially outwardly such that the distributor can be fixed between two parts (28*a*, 28*b*) of a pump casing (28).

14. A pump assembly having at least one flow-routing component as claimed in claim 1.

15. The pump assembly as claimed in claim 14, which is a single-stage or multistage centrifugal pump assembly.

16. A method of forming a flow-routing component of a pump, the component being one of a pump impeller and a pump distributor, the method comprising:

manufacturing a first shroud (2; 18) by metal-powder injection molding; and manufacturing a second shroud (4; 38) from sheet metal.

17. The method of claim 16, further comprising:

assembling the first shroud (2; 18) and the second shroud (4; 38) by pressing the second shroud (4; 38) onto a portion of the first shroud (2; 18) and welding the second shroud inductively to free longitudinal edges of the first shroud.

* * * * *